US010392225B2

(12) United States Patent
Jacobs

(10) Patent No.: US 10,392,225 B2
(45) **Date of Patent: *Aug. 27, 2019**

(54) SUSPENSION AND LIFT MOTOR SYSTEMS FOR A PLURALITY OF ELEVATOR CABS AND COUNTERWEIGHTS THAT MOVE INDEPENDENTLY OF EACH OTHER IN DIFFERENT SECTIONS OF A HOISTWAY

(71) Applicant: Smart Lifts, LLC, Menlo Park, CA (US)

(72) Inventor: Justin Jacobs, Menlo Park, CA (US)

(73) Assignee: Smart Lifts, LLC, Menlo Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/105,924

(22) Filed: Aug. 20, 2018

(65) Prior Publication Data

US 2018/0354752 A1 Dec. 13, 2018

Related U.S. Application Data

(63) Continuation of application No. 15/081,741, filed on Mar. 25, 2016, now Pat. No. 10,053,332.

(51) Int. Cl.
*B66B 9/00* (2006.01)
*B66B 11/00* (2006.01)

(52) U.S. Cl.
CPC ..... *B66B 9/00* (2013.01); *B66B 11/0095* (2013.01)

(58) Field of Classification Search
CPC ..... B66B 9/00; B66B 15/02; B66B 11/0095
See application file for complete search history.

(56) References Cited

U.S. PATENT DOCUMENTS

2004/0007428 A1 1/2004 Teramoto et al.
2004/0256179 A1 12/2004 Deplazes et al.
2007/0151810 A1 7/2007 Aulanko et al.
2008/0149427 A1 6/2008 Kocher et al.

OTHER PUBLICATIONS

International Search Report, dated Jun. 6, 2017, for corresponding International Application No. PCT/US2017/024144.
Written Opinion of the International Searching Authority, dated Jun. 6, 2017, for corresponding International Application No. PCT/US2017/024144.

*Primary Examiner* — Diem M Tran
(74) *Attorney, Agent, or Firm* — Intellectual Property Law Group LLP

(57) ABSTRACT

An elevator system comprising multiple elevator cabs operating independently in an elevator shaft. Each cab comprises a pair of underslung suspension cables, equally spaced apart from the center of the cab; a lift motor at a top surface of the shaft having an axle with a traction sheave at each end of the axle; each set of suspension cables connected at a first end to a hook at the top surface, engaging a pulley connected to a counterweight, engaging a first traction sheave, engaging a cab pulley, slung under the cab, engaging a second cab pulley and terminating at a second end connected to the top surface. Each set of four cab pulleys of each elevator cab is progressively and symmetrically located closer to the center of each cab, so that suspension cables, counterweights, pulleys, hooks, lift motors, axles, and traction sheaves will not horizontally or vertically conflict with each other.

16 Claims, 13 Drawing Sheets

SUSPENSION AND LIFT MOTOR SYSTEMS FOR A PLURALITY OF ELEVATOR CABS AND COUNTERWEIGHTS THAT MOVE INDEPENDENTLY OF EACH OTHER IN DIFFERENT SECTIONS OF A HOISTWAY

CROSS-REFERENCE TO RELATED APPLICATIONS

This application is a continuation of commonly owned U.S. patent application Ser. No. 15/081,741, filed on Mar. 25, 2016, which is hereby incorporated by reference in its entirety.

FIELD OF INVENTION

The invention generally relates to the suspension and lift motor configuration of an elevator system that has a plurality of elevator cabs and counterweights which move independently of each other in an elevator shaft.

BACKGROUND

Current elevator systems that can operate two or more elevator cabs in the same hoistway may have certain difficulties with their suspension systems and their lift motor systems that are connected by multiple cables and pulleys to a plurality of elevator cabs and counterweights in a hoistway. One of these problems is keeping each elevator cab rectilinearly balanced and symmetrical with respect to every other elevator cab in an elevator shaft, and with respect to each elevator shaft and guide track all at the same time, during their vertical motions up or down an elevator shaft.

Another problem involves avoiding or minimizing torque of the cables, guides, guide tracks, counterweights and elevator cabs of the system. Yet another problem is the number, positions and placements of the cables, counterweights, pulleys, and motors that are necessary to lift, balance and guide each elevator cab along each guide track through each elevator shaft.

This invention is intended to resolve all of these problems (and possibly others) with the cable suspension systems, cables, pulleys, counterweights, and lift motor systems illustrated in the figures, and described in the specifications.

SUMMARY

Embodiments of the present invention solve the aforementioned problems and disadvantages. According to an embodiment, there is an elevator system comprising a plurality of elevator cabs operating independently of each other in an elevator shaft of a structure, the elevator system comprising: at least two elevator cabs positioned vertically in the elevator shaft, each cab comprising: a first set of suspension cables and a second set of suspension cables, equally spaced apart from a center of each cab and substantially parallel to a front wall and a rear wall of each cab, each set of cables connected to the cab by two sets of cab pulleys located at a bottom of the cab such that each set of cables is slung under the bottom of the cab, wherein the two sets of cab pulleys for each set of suspension cables are symmetrically positioned at the bottom of the cab; a lift motor at a top surface of the shaft comprising an axle and a traction sheave at each end of the axle, wherein a first traction sheave engages the first set of suspension cables and a second traction sheave engages the second set of suspension cables; a counterweight for each set of suspension cables engaging a counterweight pulley.

According to the embodiment, the first set of suspension cables are connected at a first end to the top surface of the shaft, engaging a first counterweight pulley and a first counterweight, engaging the first traction sheave, engaging two opposing cab pulleys at the bottom of the cab, and connected at a second end to the top surface of the shaft; the second set of suspension cables connected at a first end to the top surface of the shaft, engaging a second counterweight pulley and a second counterweight, engaging the second traction sheave, engaging the other two opposing cab pulleys at the bottom of the cab, and connected at a second end to the top surface of the shaft.

In addition, according to the embodiment, each lift motor of each cab moves its corresponding two sets of suspension cables in unison with equal force and each of the elevator cabs is moveable rectilinearly within the elevator shaft independently of other cabs. Moreover, according to the embodiment, the two opposing cab pulleys for each set of suspension cables of each cab are progressively and symmetrically located closer to the center of each cab, such that for each cab, suspension cables, counterweights, pulleys, lift motors, axles, and traction sheaves will not horizontally or vertically conflict with each other.

In another embodiment of the present invention, for every cab in the elevator system, each of the sets of cab pulleys is mounted at a top of the elevator cab instead of at the bottom of the cab, such that each elevator cab is suspended from suspension cables that engage cab pulleys above the elevator cab in a same way that suspension cables engage counterweight pulleys mounted on a top of counterweights.

According to another embodiment of the present invention, the elevator system comprises at least two elevator cabs, wherein one of the cabs is configured to have the suspension cables underslung the cab, and at least for another cab of the at least two cabs, (hereafter the "overslung elevator cab") each of the sets of cab pulleys is mounted at a top of the overslung elevator cab instead of at the bottom of the cab. According to the embodiment, the overslung elevator cab is suspended from suspension cables that engage cab pulleys above the overslung elevator cab in a same way that suspension cables engage counterweight pulleys mounted on a top of counterweights.

For each overslung elevator cab according to an embodiment, a counterweight for each set of suspension cables engaging a counterweight pulley, the first set of suspension cables connected at a first end to the top surface of the shaft, engaging a first counterweight pulley and a first counterweight, engaging a first traction sheave, engaging two opposing cab pulleys at the top of the cab, and connected at a second end to the top surface of the shaft; the second set of suspension cables connected at a first end to the top surface of the shaft, engaging a second counterweight pulley and a second counterweight, engaging a second traction sheave, engaging the other two opposing cab pulleys at the top of the cab, and connected at a second end to the top surface of the shaft.

Additional features and benefits of the exemplary embodiment(s) of the present invention will become apparent from the detailed description, figures and claims set forth below.

BRIEF DESCRIPTION OF THE DRAWINGS

The exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE INVENTION

Embodiments of the present invention are now described with reference to the figures where like reference numbers and letters indicate identical or functionally similar elements.

Also, in the specification, the left most digit(s) of each reference number corresponds to the figure in which the reference number is first used. All elements of the present invention may be configured, composed, structured, positioned, or operated somewhat differently.

Reference in the specification to "one embodiment" or to "an embodiment" means that a particular feature, structure, or characteristic described in connection with the embodiments is included in at least one embodiment of the invention. The appearance of the phrase "in one embodiment" in various places in the specification are not necessarily all referring to the same embodiment.

The language used in the specification has been principally selected for readability and instructional purposes, and may not have been selected to delineate or circumscribe the inventive subject. Accordingly, the disclosure of the present invention is intended to be illustrative, but not limiting, of the scope of the invention, which is set forth in the claims. Persons with ordinary skill in the art would be able to design other embodiments of the present invention without undo effort or experimentation.

Figure 1:
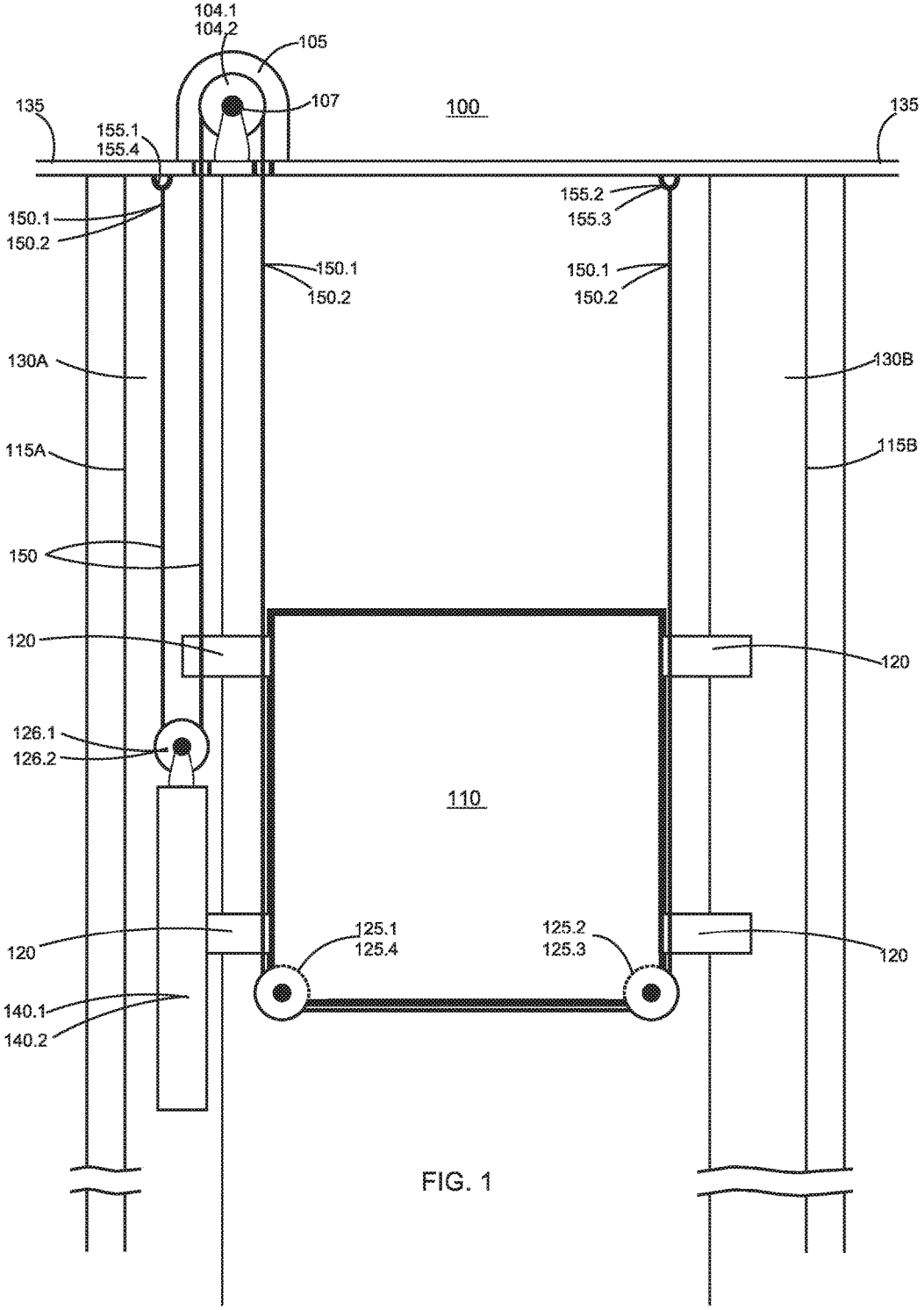
FIG. 1 is an illustration of a front view of an elevator shaft with one elevator cab suspended by cables, and its respective counterweights, cables, pulleys, guides, lift motor, axle, and traction sheaves, according to an embodiment of the present invention.

FIG. 1 is an illustration of the front view of an elevator shaft 100 which contains one elevator cab 110 positioned between two elevator guide tracks 130A and 130B and each guide track 130 is located at the center of two opposing walls of elevator shaft 100, wherein each guide track 130 can be attached to an opposing interior side 115 of elevator shaft 100, according to one embodiment of the present invention. Guides 120 can be attached to the exterior center of two opposite exterior sides of elevator cab 110, and these guides 120 can guide elevator cab 110 up or down each guide track 130 in elevator shaft 100. Pulleys 125 can be attached to the bottom or top (not shown) of elevator cab 110. Counterweights 140.1 and 140.2 that move up or down the interior sides 115A of elevator shaft 100 can be connected by cables 150.1 and 150.2 respectively to elevator cab 110 through pulleys 126.1 and 126.2 respectively as further shown in FIG. 3, all according to one embodiment of the present invention. Counterweight 140.2, associated cable 150.2 and pulley 126.2 on the rear side of elevator cab 110 are hidden directly behind respective counterweight 140.1, cable 150.1 and pulley 126 on the front side of the elevator cab.

A lift motor 105 associated with elevator cab 110 can be positioned on an attic floor 135 of a structure directly above the center of the left side (or right side, not shown) of elevator cab 110. In other words, the lift motor 105 is located centered between the front (near side) wall and the rear (far side) wall. Passing through the center of the lift motor 105 there can be an axle (or rod) 107. On each end of the axle 107, substantially equidistant from the center of the lift motor 105, there can be attached a traction sheave 104 (which resembles a pulley), all as further shown in FIG. 3.

Elevator cab 110 and each associated counterweight 140 in elevator shaft 100 can be suspended by cables 150 in the manner shown in FIG. 1. A first group of cables 150.1 can be positioned on the near side (i.e. front side of the cab, side closest to the person viewing FIG. 1, hereinafter "near" referring to the front of the cab) of guide tracks 130A and 130B and one end of the first group of cables 150.1 can be attached to a hook 155.1 which can be mounted on the near bottom of attic floor 135 (or elsewhere). The other end of the first group of cables 150.1 can pass down the near side 115A of elevator shaft 100 around counterweight pulley 126.1 mounted on the top of counterweight 140.1, then back up the near side 115A and around the near traction sheave 104.1 attached to the near end of the axle 107, then directly down the left near side of elevator cab 110 around cab pulley 125.1 at a bottom near corner of cab 110, across the near bottom of cab 110 and around another cab pulley 125.2 at the opposite bottom near corner of cab 110, then directly up the right near side of cab 110 to another hook 155.2 mounted on the near bottom of attic floor 135, where the other end of the first group cables 150.1 can be attached, as further shown in FIG. 3, all according to one embodiment of the present invention, A second group of cables 150.2 can be positioned on the opposite (far) sides of guide tracks 130B and 130A (i.e. the far side being the rear of the cab, hereinafter "far" referring to the rear of the cab), and one end of the second group of cables 150.2 can be attached to a different hook 155.3 (located on the far side of guide track 130B) which hook can be mounted on the far bottom of attic floor 135 (or elsewhere). The other end of the second group of cables 150.2 can pass down the far side 115B of the elevator shaft 100, then directly down the right far side of elevator cab 110, around cab pulley 125.3 (located at the far end of cab 110, behind pulley 125.2, not shown), then across the far bottom of cab 110 and around another cab pulley 125.4 (located at the far left end of cab 110, not shown), then directly up the far left side of cab 110 over and around far left traction sheave 104.2 (located behind lift motor 105, not shown) and down the far left side 115A of elevator shaft 100, around counterweight pulley 126.2 mounted on the top of counterweight 140.2 (located on the far left side of elevator shaft 100, not shown), then directly up the far left side 115A of elevator shaft 100 to another hook 155.4 mounted on the far left bottom of attic floor 135 (not shown) where the other end of the second group of cables 150.2 can be attached, as further shown in FIG. 3, all according to one embodiment of the present invention. These two suspension cable configurations of cab 110 can be referred to as an "underslung" suspension system for cab 110.

When each traction sheave 104 of lift motor 105 rotates in one direction, cables 150 will cause cab 110 to move uniformly down elevator shaft 100, and when each traction sheave 104 of lift motor 105 rotates in the opposite direction, cables 150 will cause cab 110 to move uniformly up elevator shaft 100, according to one embodiment of the present invention.

In a preferred embodiment, each cab 110 in shaft 100 can be suspended (underslung) by two groups of suspension cables 150 which can be symmetrically underslung around each cab 110 as described above and each group of suspension cables can be associated with a different set of two counterweights 140 in the manner described above, and as further shown on FIG. 2 and FIG. 3.

As each additional elevator cab 110 is inserted into shaft 100, each set of four cab pulleys 125 can be progressively and symmetrically located closer to the center of each elevator cab 110, so that each cab's suspension cables 150, counterweights 140, pulleys 125, 126, suspension cable hooks 155, lift motors 105, axles 107, and traction sheaves 104 will not horizontally or vertically conflict with each other. In addition, the highest cab 110 of a group of cabs 110A, 110B, 110C, 100D (not shown) in an elevator shaft 100 must have counterweights that are reciprocally the lowest in an elevator shaft 100, so that the elevator cabs 110 and counterweights 140 will not collide or conflict with each other. For examples see FIG. 2, FIG. 3, FIG. 4, FIG. 5, FIG. 6, FIG. 7, FIG. 8, FIG. 9 and FIG. 10.

Figure 2:
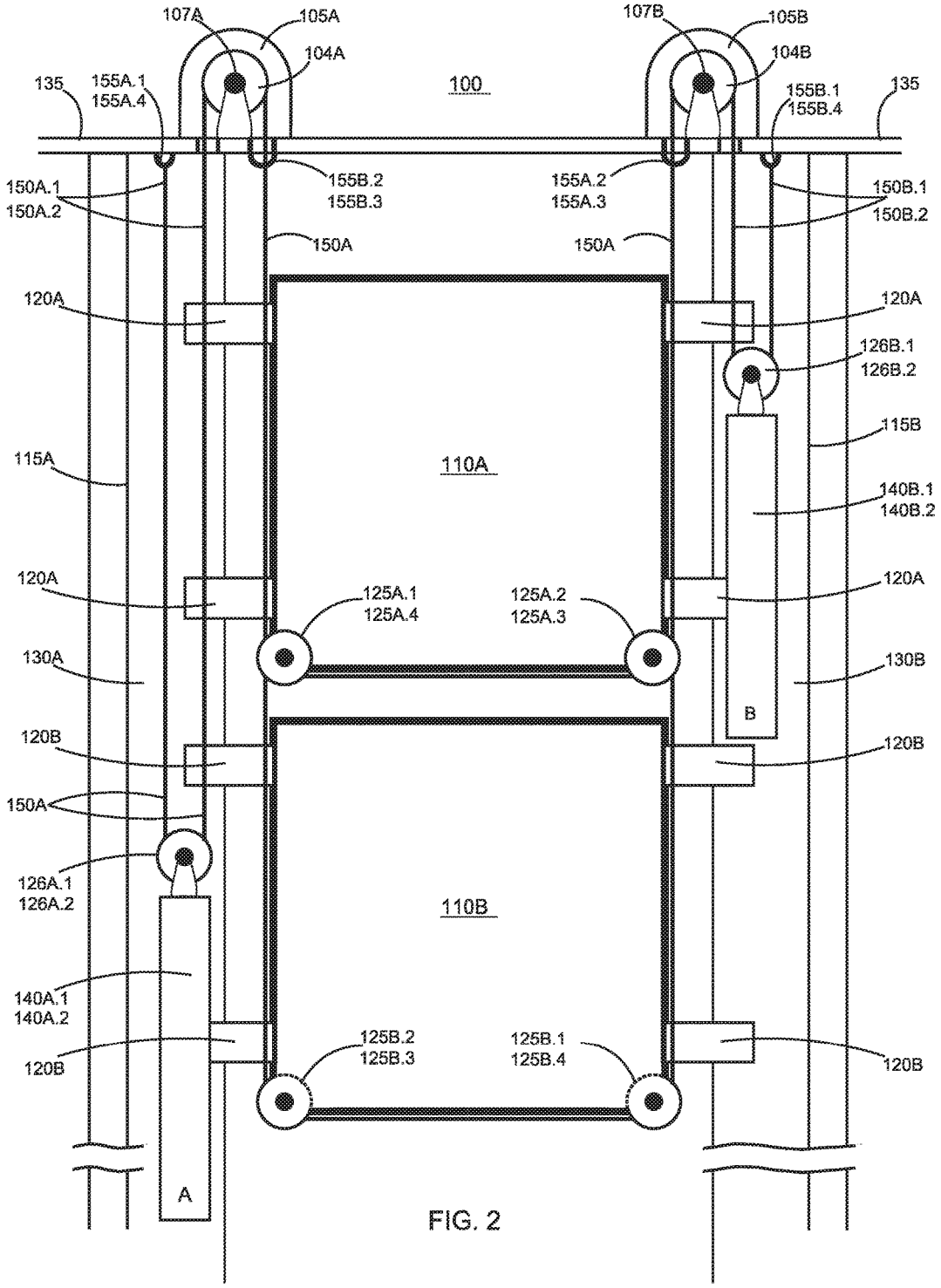
FIG. 2 is an illustration of a front view of an elevator shaft with two elevator cabs suspended by cables, one above the other, and their respective pulleys, guides, cables, counterweights, lift motors, axles, and traction sheaves, according to an embodiment of the present invention.

FIG. 2 is an illustration of the front view of an elevator shaft 100 which contains two elevator cabs, 110A and 110B, one above the other. Each cab 110 can be positioned between two elevator guide tracks 130A and 130B and each guide track 130 can be located at the center of two opposing interior walls of shaft 100, wherein each guide track 130 can be attached to each opposing interior side 115 of the elevator shaft 100, according to one embodiment of the present invention. Guides 120 can be attached to the center of two opposite exterior sides of each elevator cab 110, and these guides 120 can guide each elevator cab 110 up or down each guide track 130. Pulleys 125 can be attached to the bottom or top (not shown) of each elevator cab 110. Counterweights 140 that move up or down the elevator shaft 100 can be associated with each elevator cab 110, and pulleys 126 that are attached to the top of each counterweight 140 can be associated with each elevator cab 110, as further shown in FIG. 3, all according to one embodiment of the present invention.

A lift motor 105A associated with elevator cab 110A can be positioned on an attic floor 135 of a structure directly above the center of the left side of elevator cab 110A. Passing through the center of lift motor 105A there can be an axle 107A. On each end of the axle 107A, substantially equidistant from the center of lift motor 105A, there can be attached a traction sheave 104A, all as further shown in FIG. 3.

A lift motor 105B associated with elevator cab 110B can be positioned on an attic floor 135 of a structure directly above the center of the right side of elevator cab 110B. Passing through the center of lift motor 105B there can be an axle 107B. On each end of the axle 107B, substantially equidistant from the center of lift motor 105B, there can be attached a traction sheave 104B, all as further shown in FIG. 3.

Elevator cab 110A and its near counterweight 140A.1 (front wall side) can be suspended (underslung) by a first group of cables 150A.1 in the same manner as the first group of cables 150.1 shown and described in FIG. 1. Elevator cab 110A and its far counterweight 140A.2 (rear wall side-not shown) can be suspended (underslung) by a second group of cables 150A.2 in the same manner as the second group of cables 150.2 shown and described in FIG. 1, according to one embodiment.

Similarly, elevator cab 110B and its two counterweights 140B, can be suspended (underslung) in substantially the same manner as cab 110A in the opposite direction, except that cables 150B, pulleys 125B and 126B, suspension cable hooks 155B, counterweights 140B, and the traction sheaves 104 associated with cab 110B must all be symmetrically positioned closer to the central guide tracks 130A and 130B as shown on FIG. 3, FIG. 4 and FIG. 5, and as later described in the specifications, so that they will not conflict with similar elements associated with elevator cab 110A, according to one embodiment.

Figure 11:
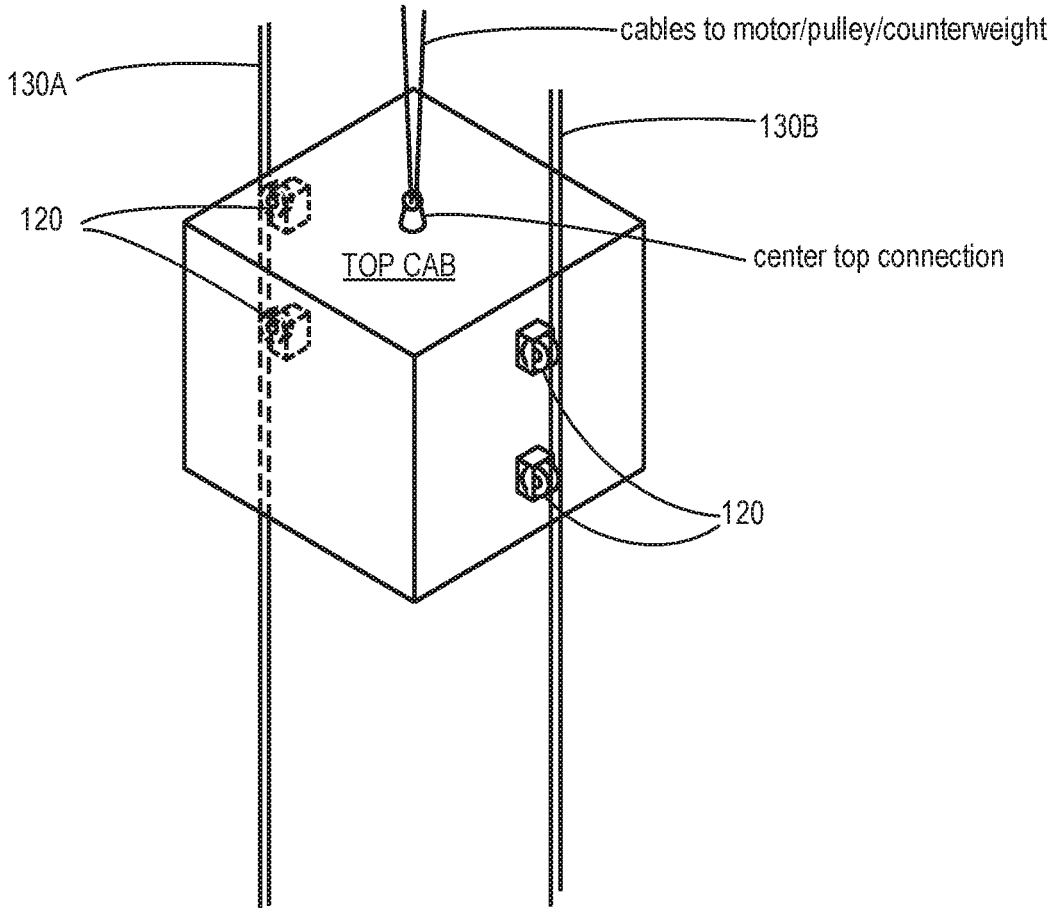
FIG. 11 illustrates a topmost cab with a conventional top of the cab centered suspension system, according to an embodiment of the present invention.

When each traction sheave 104 of each lift motor 105 rotates in one direction, cables 150 will cause each cab 110 to move uniformly down elevator shaft 100, and when each traction sheave 104 of each lift motor 105 rotates in the opposite direction, cables 150 will cause each cab 110 to move uniformly up elevator shaft 100, according to one embodiment of the present invention. Although not shown in FIG. 2, an additional elevator cab 110 (see FIG. 11) with a conventional center top of the elevator cab suspension system can be positioned at the top of elevator shaft 100 above the other two cabs 110 in order to increase the number of elevator cabs 110 that can independently operate in such shaft 100.

Figure 3:
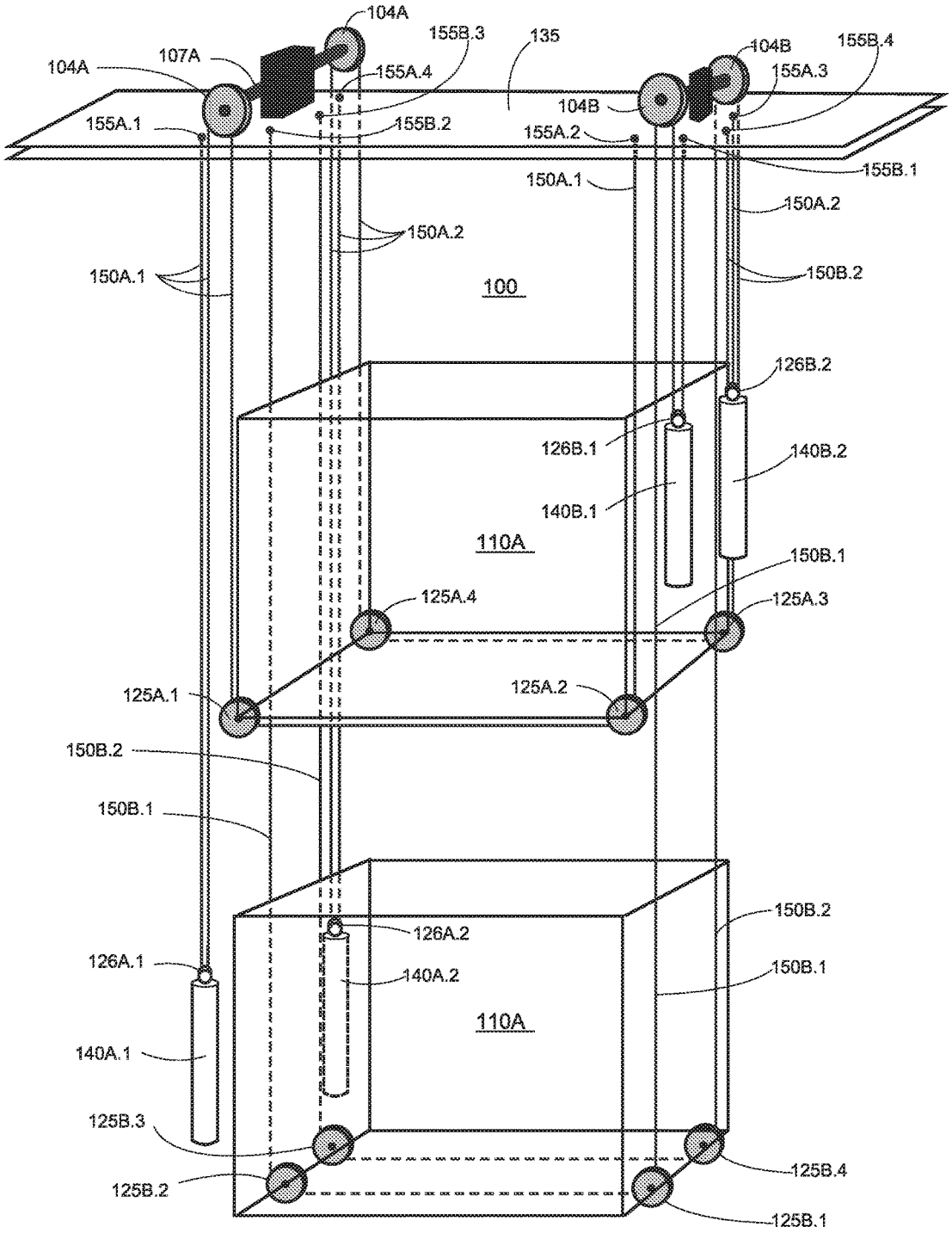
FIG. 3 is an illustration of FIG. 2 from an oblique angle with the two elevator cabs and counterweights suspended at different levels than in FIG. 2, according to an embodiment of the present invention.

FIG. 3 is an illustration of FIG. 2 from an oblique angle with the two elevator cabs and counterweights suspended at different levels than in FIG. 2, according to an embodiment of the present invention. The specification of FIG. 2 also applies to FIG. 3.

Figure 4:
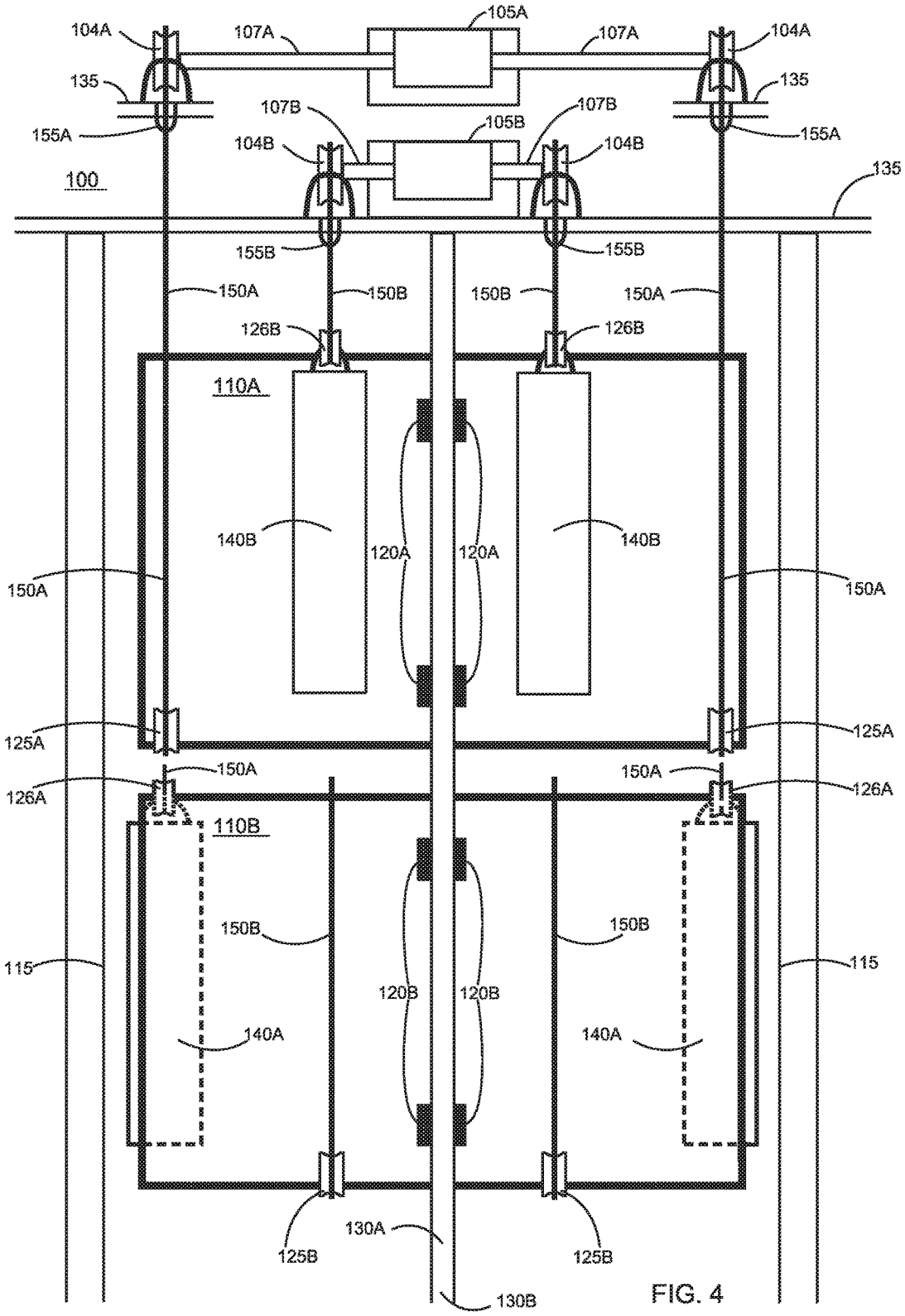
FIG. 4 is an illustration of a right side view of FIG. 2, according to an embodiment of the present invention.

FIG. 4 is an illustration of a side view of FIG. 2. In FIG. 4, there are two elevator cabs 110A and 110B suspended (underslung) by cables 150 in an elevator shaft 100. Elevator cab 110A can be underslung by two symmetrical groups of cables 150A, and elevator cab 110B can be underslung by two symmetrical groups of cables 150B. Four cab pulleys 125A (only two are shown) through which cables 150A pass can be symmetrically located at the outer corners of elevator cab 110A, and four cab pulleys 125B (only two are shown) through which cables 150B pass can be symmetrically located toward the center of elevator cab 110B. The guides 120 of each elevator cab 110 which guide each cab 110 along a guide track 130 can be positioned at the center of each elevator cab 110. The two counterweights 140A associated with elevator cab 110A are always located below the two counterweights 140B associated with elevator cab 110B and within the sides 115 of the elevator shaft 100. When elevator cab 110A is at the top of shaft 100, counterweights 140A are at the bottom of shaft 100, and this configuration is similar with respect to cab 110B and its two counterweights 140B, all according to one embodiment of the present invention. In order to better illustrate the location of the counterweights, cables and cab pulleys, the side view of elevator cab 110B is presented in a partially see-through manner and cables 150A and 150B are shown in indeterminate length.

As shown on FIG. 4, lift motor 105B can be positioned over the center of guide track 130B, axle 107B can pass through the center of lift motor 105B, axle 107B can also be centered over guide track 130B, and each traction sheave 104B can be attached to one end of axle 107B. This permits each cable 150B to symmetrically pass around cab pulleys 125B, around counterweight pulleys 126B, and around each traction sheave 104B without conflicting with any other element.

Also as shown on FIG. 4, lift motor 105A can be positioned over the center of guide track 130A, but on the opposite side of elevator cab 110A than lift motor 105B. Axle 107A can pass through the center of lift motor 105A, axle 107A can also be centered over guide track 130A, and each traction sheave 104A can be attached to one end of axle 107A. This permits each cable 150A to symmetrically pass around cab pulleys 125A, around counterweight pulleys 126A, and around each traction sheave 104A without conflicting with any other element. In order to make the above specification clear, lift motor 105A, axle 107A and traction sheaves 104B are shown on FIG. 4 above motor 105B, axle 107B and traction sheaves 104B, i.e. attic floor 135 is shown offset at two levels.

When lift motor 105A and its two traction sheaves 104A uniformly pulls suspension cables 150A of cab 110A up or down shaft 100, the guides 120A, the guide tracks 130, the underslung cables 150A, the pulleys 125A and 126A, and the equally weighted counterweights 140A in conjunction with each other keep elevator cab 110A balanced and rectilinear relative to the sides 115 of the elevator shaft 100 and each other cab 110 in shaft 100, according to one embodiment Likewise, when lift motor 105B and its two traction sheaves 104B uniformly pulls suspension cables of cab 110B up or down the shaft 100, the guides 120B, the guide tracks 130, the underslung cables 150B, the pulley's 125B and 126B, and the equally weighted counterweights 140B in conjunction with each other keep elevator cab 110B balanced and rectilinear relative to the sides 115 of the elevator shaft 100 and each other cab 110 in shaft 100, according to one embodiment. Note that there is only one lift motor 105 necessary to move each cab 110 in this manner.

Figure 5:
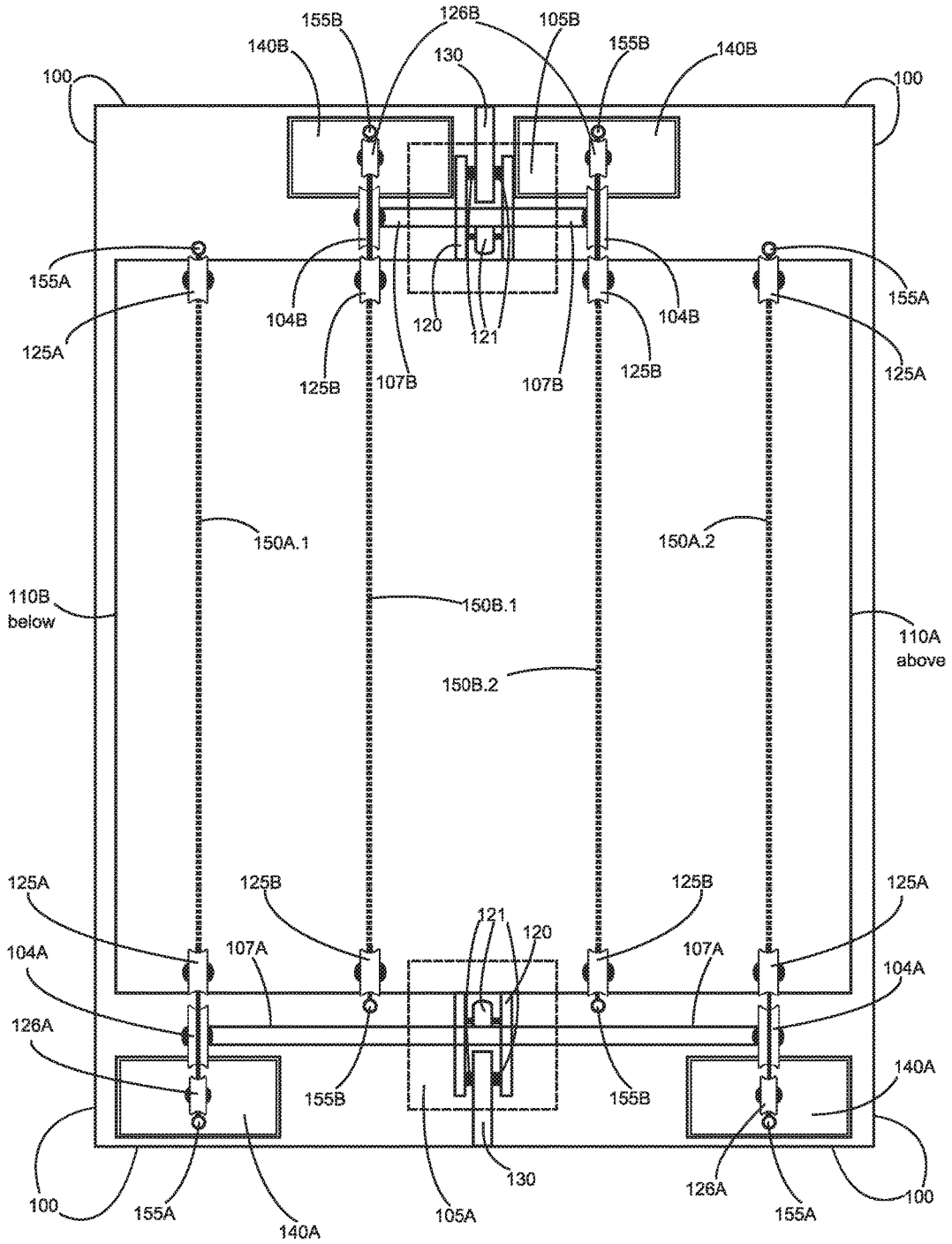
FIG. 5 is an illustration of a top view of FIG. 2, according to an embodiment of the present invention.

FIG. 5 is an illustration of a top view of two elevator cabs 110A and 110B suspended (underslung) by cables 150 in an elevator shaft 100, one above the other, with their respective counterweights 140, pulleys 125, 126, guides 120, lift motors 105, axles 107, traction sheaves 104, and cable hooks 155. Each elevator cab 110 can be guided through shaft 100 by guides 120 rolling along two opposing guide tracks 130, according to one embodiment. In FIG. 5, the underslung suspension cables 150 are shown as straight dotted lines. Each cab 110 can be connected to two or more counterweights 140A and 140B by cables 150 moving through pulleys 125, 126, as further shown and described in FIG. 3 and FIG. 4. Each lift motor 105 in conjunction with guide tracks 130, guides 120, pulleys 125, 126, counterweights 140, suspension cables 150, axles 107 and traction sheaves 104, can move each cab 110 rectilinearly up or down shaft 100 as shown on FIG. 3 and FIG. 4. Each guide 120 is shown with three opposing wheels 121 rolling along each guide track 130. [Note: If necessary, two additional counterweights 140B, and two additional counterweights 140A can be positioned at the opposite sides of those counterweights 140 shown, in substantially the same manner as shown on FIG. 4.]

Figure 6:
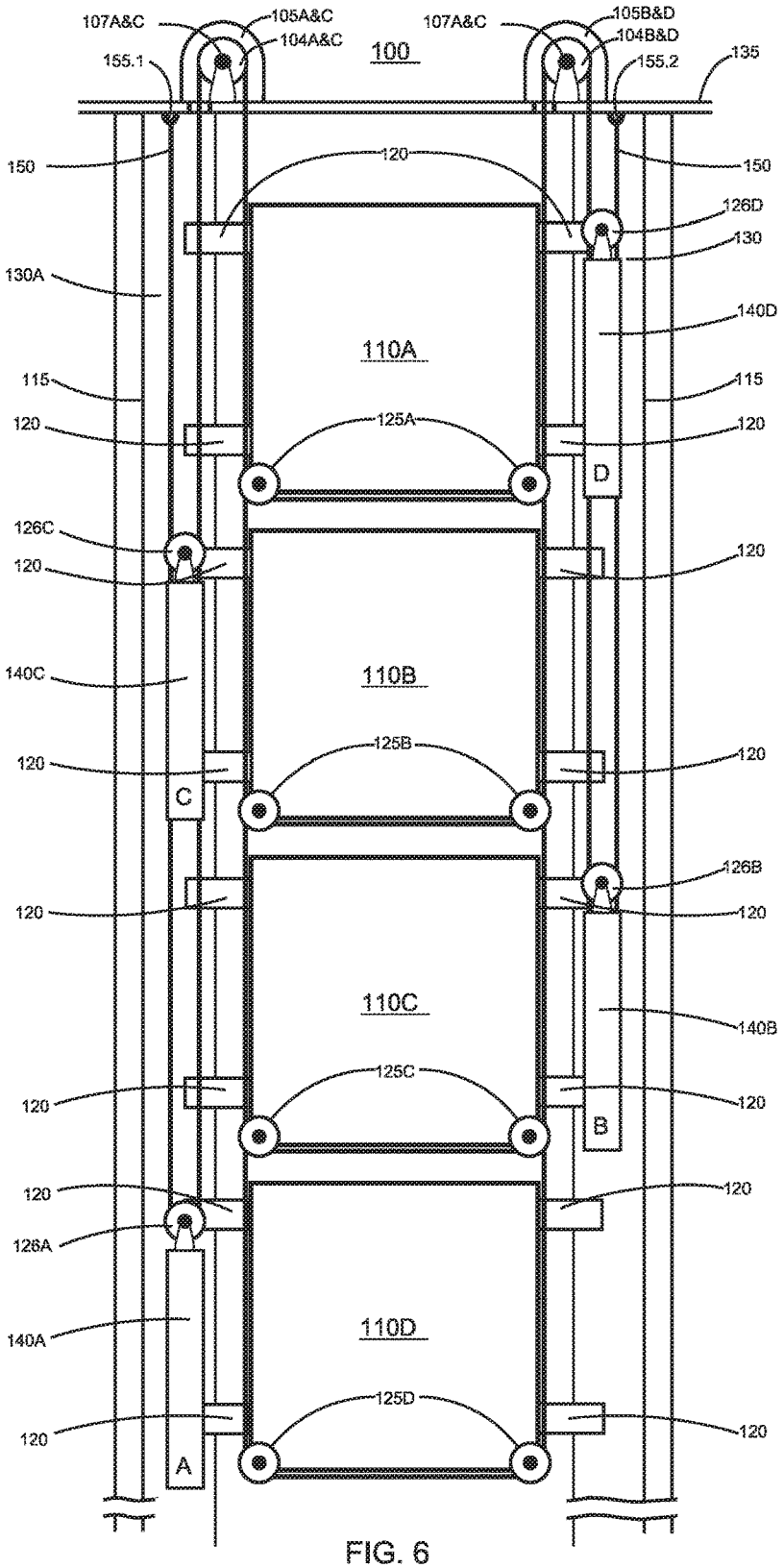
FIG. 6 is an illustration of a front view of an elevator shaft with four elevator cabs suspended by cables in an elevator shaft, and their respective counterweights, cables, pulleys, guides, lift motors, axles and traction sheaves, according to an embodiment of the present invention.

FIG. 6 is an illustration of the front view of an elevator shaft 100 which contains four elevator cabs 110A, 110B, 110C, 110D. Each cab can be positioned between two elevator guide tracks 130A and 130B, wherein each guide track 130 can be attached to the center of an opposing interior side 115 of the elevator shaft 100, according to one embodiment. Guides 120 can be attached to each exterior side of each elevator cab 110, and these guides 120 can guide each elevator cab 110 up or down each guide track 130. Pulleys 125 can be attached to the bottom or top (not shown) of each elevator cab 110. A lift motor 105 associated with each elevator cab 110 can be positioned on attic floor 135 above each elevator cab 110 in order to move each cab 110 up or down the elevator shaft 100 in conjunction with suspension cables 150, pulleys 125, 126, axles 107, traction sheaves 104, and counterweights 140 (some are not shown). Counterweights 140 that move up and down the elevator shaft 100 can be associated with each separate elevator cab 110, and pulleys 126 that are attached to the top of each counterweight 140 can be associated with each separate elevator cab 110, all according to one embodiment.

Figure 7:
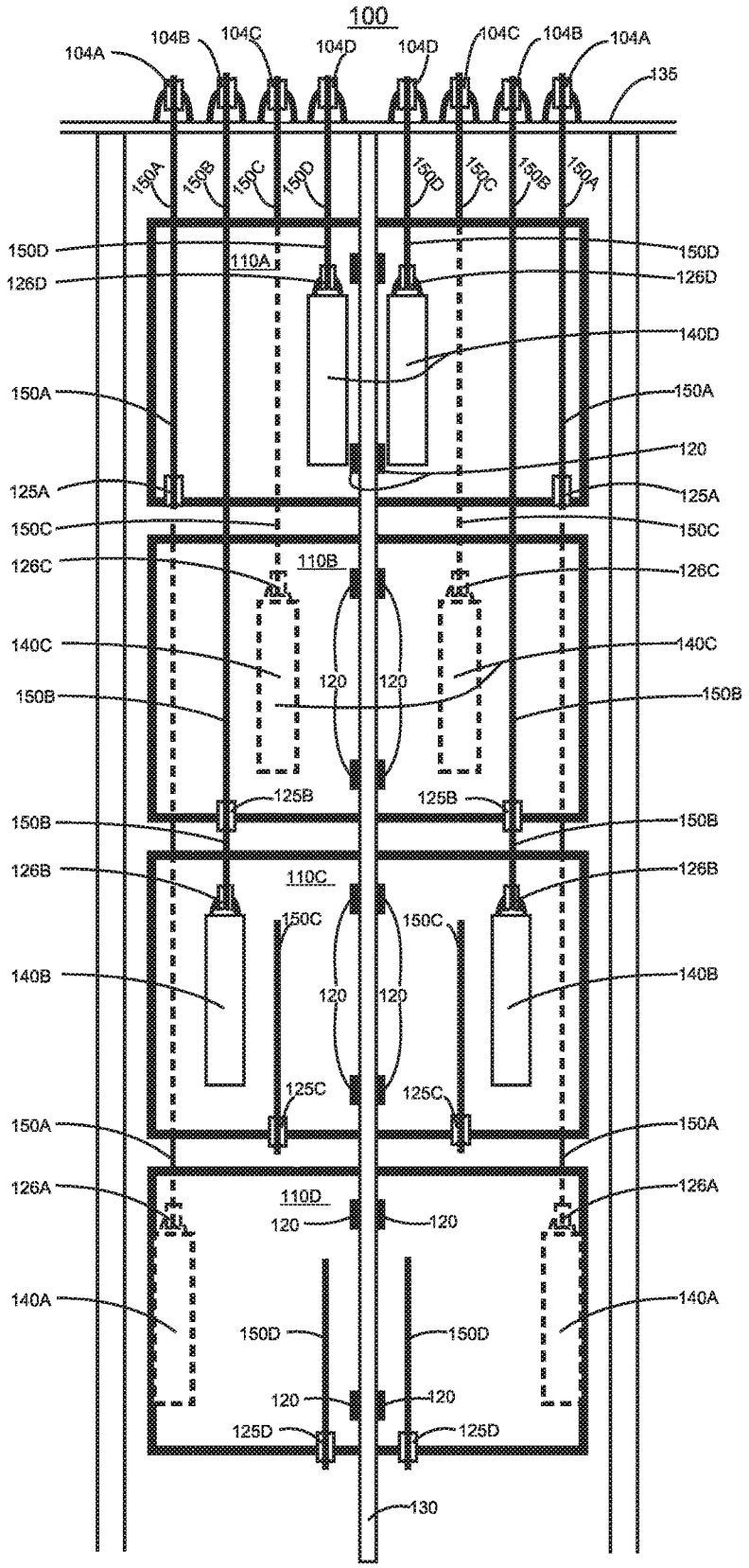
FIG. 7 is an illustration of a right side view of FIG. 6, according to an embodiment of the present invention.
Figure 8:
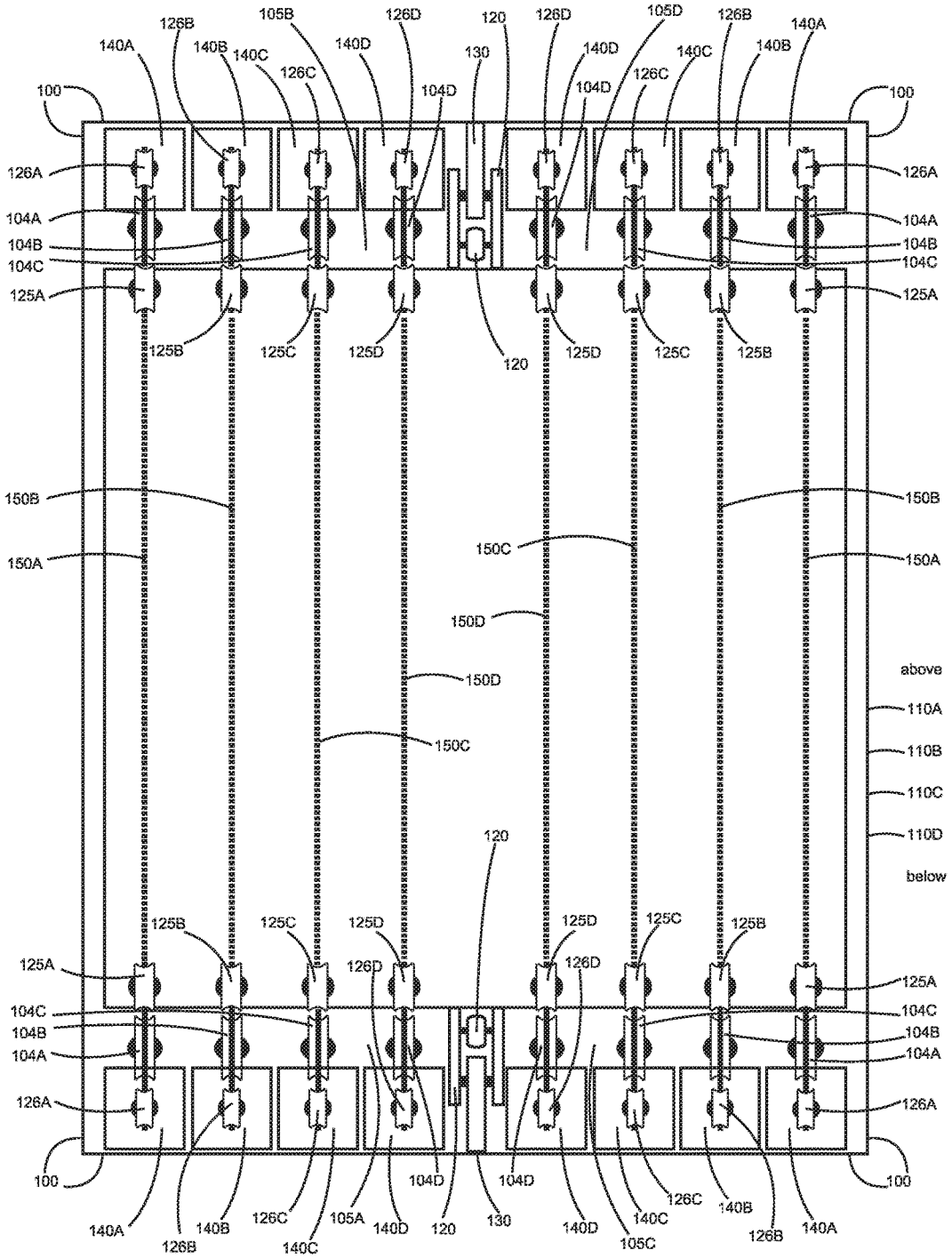
FIG. 8 is an illustration of a top view of FIG. 6, according to an embodiment of the present invention.

Elevator cab 110A and its near counterweight 140A (front side) can be suspended (underslung) by a first group of cables 150 in the same manner as the first group of cables 150.1 shown and described in FIG. 1 and FIG. 2. Elevator cab 110A and its far counterweight 140A (rear side) can be suspended (underslung) by a second group of cables 150 in the same manner as the second group of cables 150.2 shown and described in FIG. 1 and FIG. 2. Similarly, elevator cabs 110B, 110C and 110D and their two counterweights 140B, 140C and 140D can be suspended (underslung) in the same manner as cab 110A above, except that cables 150, pulleys 125, 126, suspension cable hooks 155, counterweights 140, lift motors 105, axles 107 and traction sheaves 104 associated with cabs 110B, 110C and 110D must all be progressively and symmetrically positioned closer to the central guide rails 130A and 130B as shown in FIG. 7 and FIG. 8, and as described in later specifications. Although not shown in FIG. 6, an additional elevator cab 110 with a conventional center top of the elevator cab suspension system (see FIG. 11) can be positioned at the top of elevator shaft 100 above the other four cabs 110 in order to increase the number of elevator cabs 110 that can independently operate in such shaft 100.

FIG. 7 is an illustration of a side view of FIG. 6. In FIG. 7, there are four elevator cabs 110A, 110B, 110C and 110D suspended by cables 150 in an elevator shaft 100. Each elevator cab 110 can be underslung by two symmetrical groups of cables 150. Each cable 150, pulley 125, 126, counterweight 140, can be progressively and symmetrically located toward the central guide track 130, as shown in FIG. 7 and FIG. 8. Each lift motor 105 (not shown), axle 107 (not shown) and traction sheave 104 can be appropriately positioned on attic floor 135, similarly to those shown on FIG. 4 and FIG. 5. The guides 120 of each elevator cab 110 can be positioned at the center of each elevator cab 110. When elevator cab 110A is located at the top of shaft 100, counterweights 140A are reciprocally located at the bottom of shaft 100, and this configuration of cabs 110 and counterweights 140 is similar with respect to all four cabs 110, according to one embodiment of the present invention. As in FIG. 4, in order to better illustrate the location of the counterweights, cables and cab pulleys, the side view of elevator cabs is presented in a partially see-through manner and cables are shown in indeterminate length.

FIG. 8 is an illustration of a top view of four elevator cabs 110A, 110B, 110C and 110D, suspended (underslung) by cables 150 in an elevator shaft 100, one above the other, with their respective counterweights 140, pulleys 125, 126, guides 120, guide tracks 130, lift motors 105, axles 107 and traction sheaves 104 (some not shown). In FIG. 8, the underslung suspension cables 150 are shown as dotted lines. Each cab 110 can be connected to two or more counterweights 140 by cables 150 moving through pulleys 125, 126, as further shown and described in FIG. 6 and FIG. 7. Each lift motor 105 can have associated axles 107 and traction sheaves 104. Lift motors 105 in conjunction with guide tracks 130, guides 120, pulleys 125, 126, counterweights 140, underslung suspension cables 150, axles 107 and traction sheaves 104, move each cab 110 rectilinearly up or down shaft 100 as shown on FIG. 6 and FIG. 7.

Figure 9:
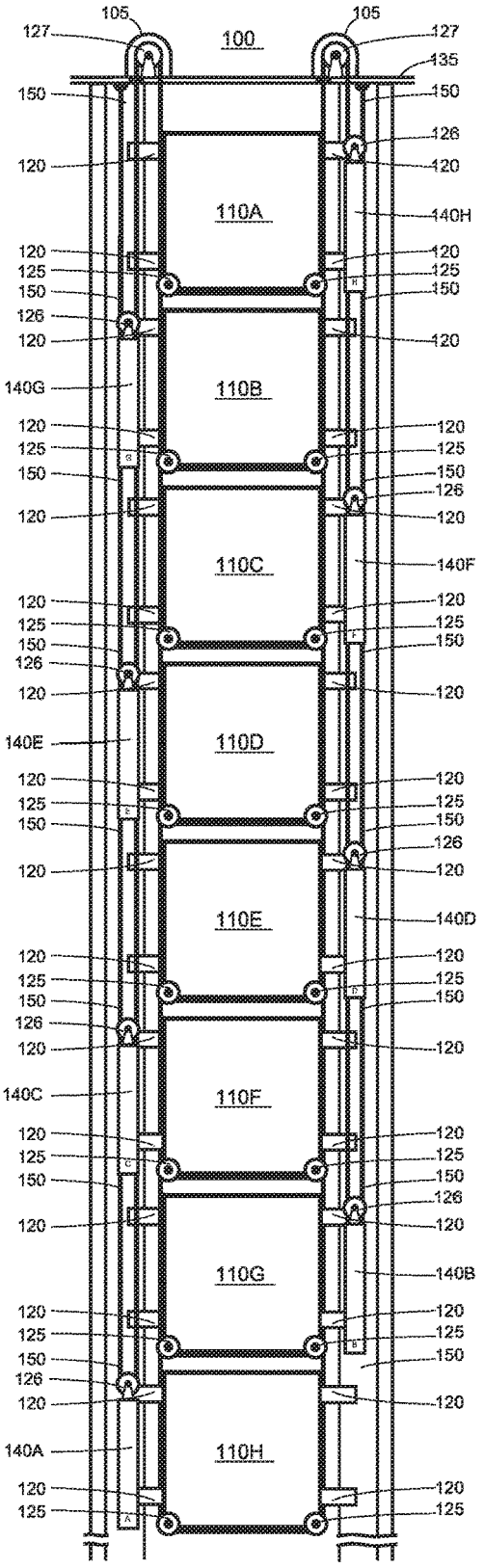
FIG. 9 is an illustration of the front view of eight elevator cabs suspended by cables in an elevator shaft, and some of their respective counterweights, pulleys, cables, and guides, according to an embodiment of the present invention.

FIG. 9 is an illustration of the front view of eight elevator cabs 110A, 110B, 110C, 110D, 110E, 110F, 110G, 110H, suspended (underslung) by cables in an elevator shaft 100, with their respective guides 120, guide tracks 130, counterweights 140, pulleys 125, 126, lift motors 105, axles 107, and traction sheaves 104 similar to those shown in FIG. 2, FIG. 3, FIG. 4, and FIG. 5 (some are not shown). Each elevator cab 110 in FIG. 9 can be symmetrically underslung (suspended) by two groups of cables 150 and each elevator cab 110 can operate in substantially the same manner as the elevator cabs illustrated in FIG. 1 through FIG. 8 and as described in the previous specifications. Although not shown in FIG. 9, an additional elevator cab 110 with a conventional center top of the elevator cab suspension system (see FIG. 11) can be positioned at the top of elevator shaft 100 above the other 8 cabs 110 in order to increase the number of elevator cabs 110 that can independently operate in such shaft 100.

Figure 10:
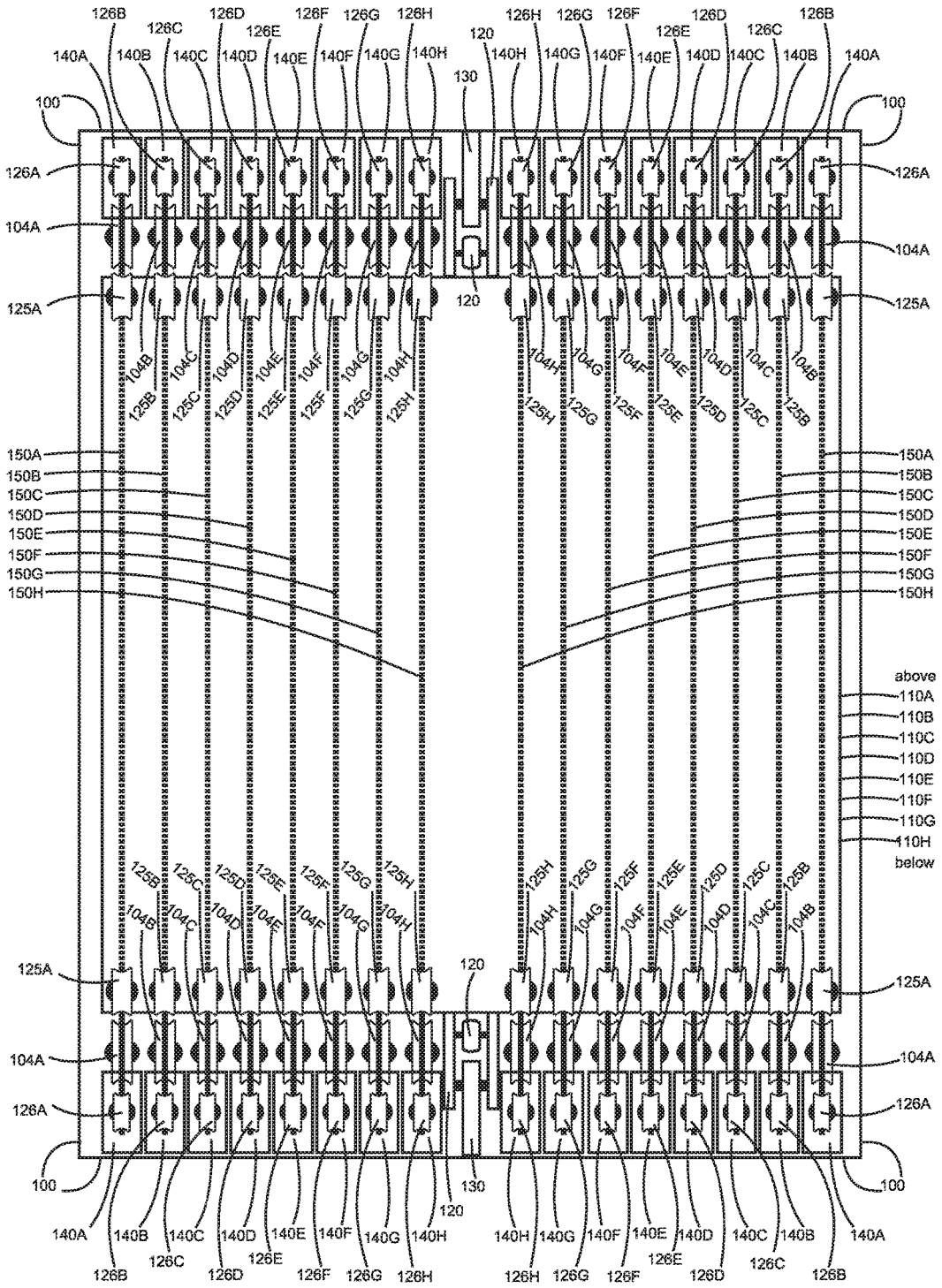
FIG. 10 is an illustration of the top view of FIG. 9, according to an embodiment of the present invention.

FIG. 10 is an illustration of the top view of FIG. 9 which shows eight elevator cabs 110A, 110B, 110C, 110D, 110E, 110F, 110G, 110H, from top to bottom in an elevator shaft 100. Each elevator cab 110 and each associated counterweight 140 can be progressively and symmetrically suspended (underslung) toward each guide track 130 by two sets of suspension cables 150 passing through pulleys 125, 126. Each guide track 130 is positioned at the center of elevator shaft 100, and each guide 120 attached to each cab 110 can be positioned over each guide track 130 from top to bottom. Each lift motor 105, axle 107 and traction sheave 104 can be located on an attic floor 135 directly above its associated elevator cab 110 (not shown). The major reason for showing and describing FIG. 9 and FIG. 10 is to demonstrate that any real elevator shaft 100 can contain up to at least nine elevator cabs 110, eight of which are underslung by cables 150.

Although illustrated as circular cables or groups of circular cables, cables 150 used in this invention may alternatively be in the form of belts or groups of belts, or any other shape or configuration of a cable. Similarly, the pulleys 125, 126, and traction sheaves 104 shown in this invention are illustrated to use circular cables, but they can be of any size, shape or other configuration so that they can also be used for belts or cables of any size, shape or other configuration.

Although pulleys 125, 126, and cables 150 illustrated in this invention are specifically shown and described as being either underslung or overslung, they may be of the opposite configuration, i.e. overslung (or any other configuration) so long as they perform the function illustrated or described in this invention. A hoistway/shaft may include a combination of elevators cabs having underslung and overslung cables (see FIGS. 12A and 12B).

Figure 12A:
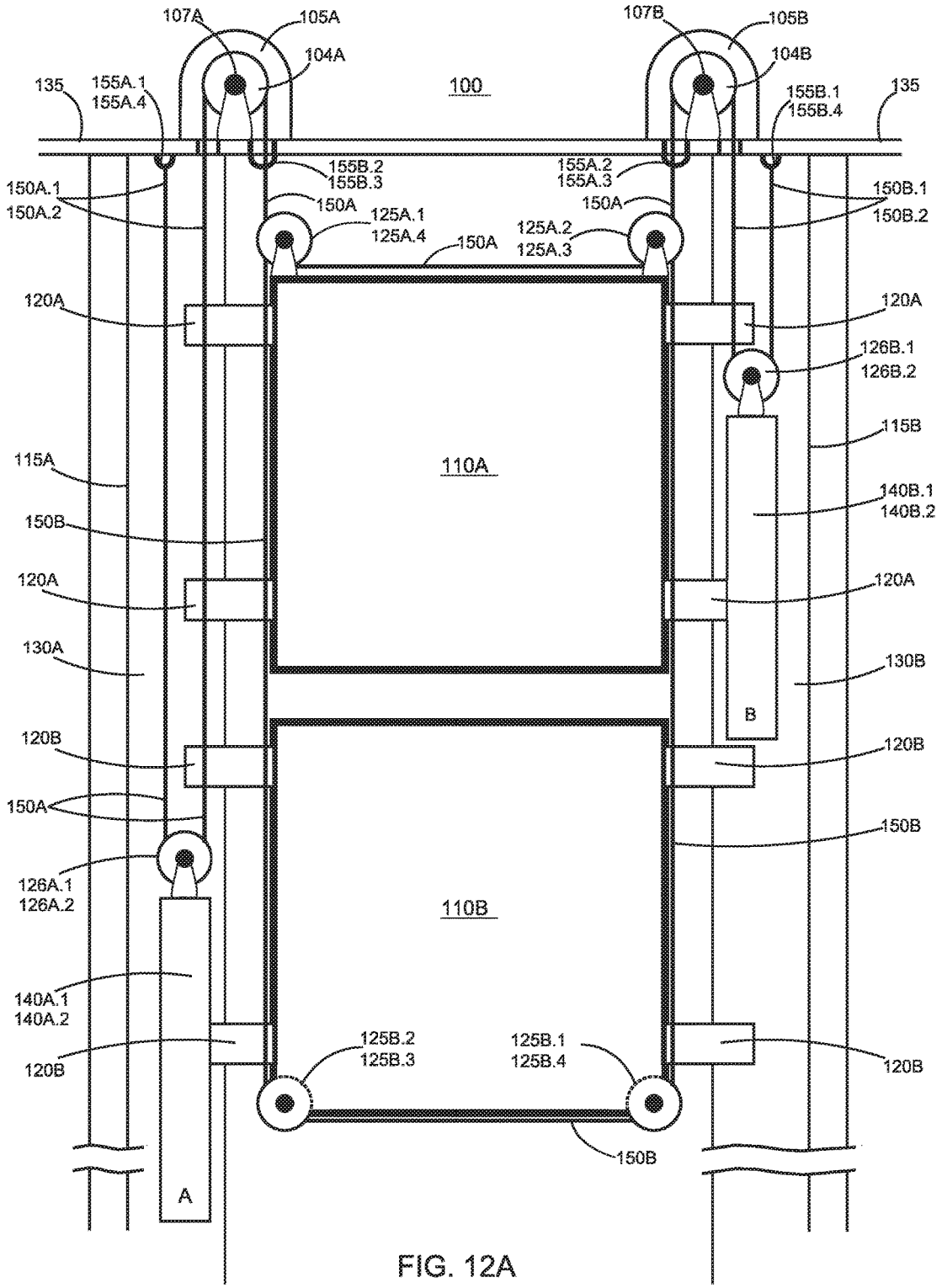
FIG. 12A is an illustration of a front view of an elevator shaft with two elevator cabs suspended by cables, one above the other, and their respective pulleys, guides, cables, counterweights, lift motors, axles, and traction sheaves, where the pulleys of the upper elevator cab are mounted at a top of the upper elevator cab, according to an embodiment of the present invention.

For example, according to an embodiment, as illustrated in FIG. 12A a shaft may have at least one elevator cab 110B having suspension cables 150B configured to be slung under the elevator cab through pulleys 125B located at the bottom of the cab; and may have at least one elevator cab 110A having suspension cables 150A configured to be slung over the elevator cab through pulleys 125A located at the top of the cab. The elevator cab with suspension cables overslung the top of the cab may comprise sets of cab pulleys 125A that are mounted at a top of the elevator cab instead of at the bottom of the cab, such that the elevator cab is suspended from suspension cables that engage cab pulleys above the elevator cab in a same way that suspension cables engage counterweight pulleys mounted on a top of counterweights.

Figure 12B:
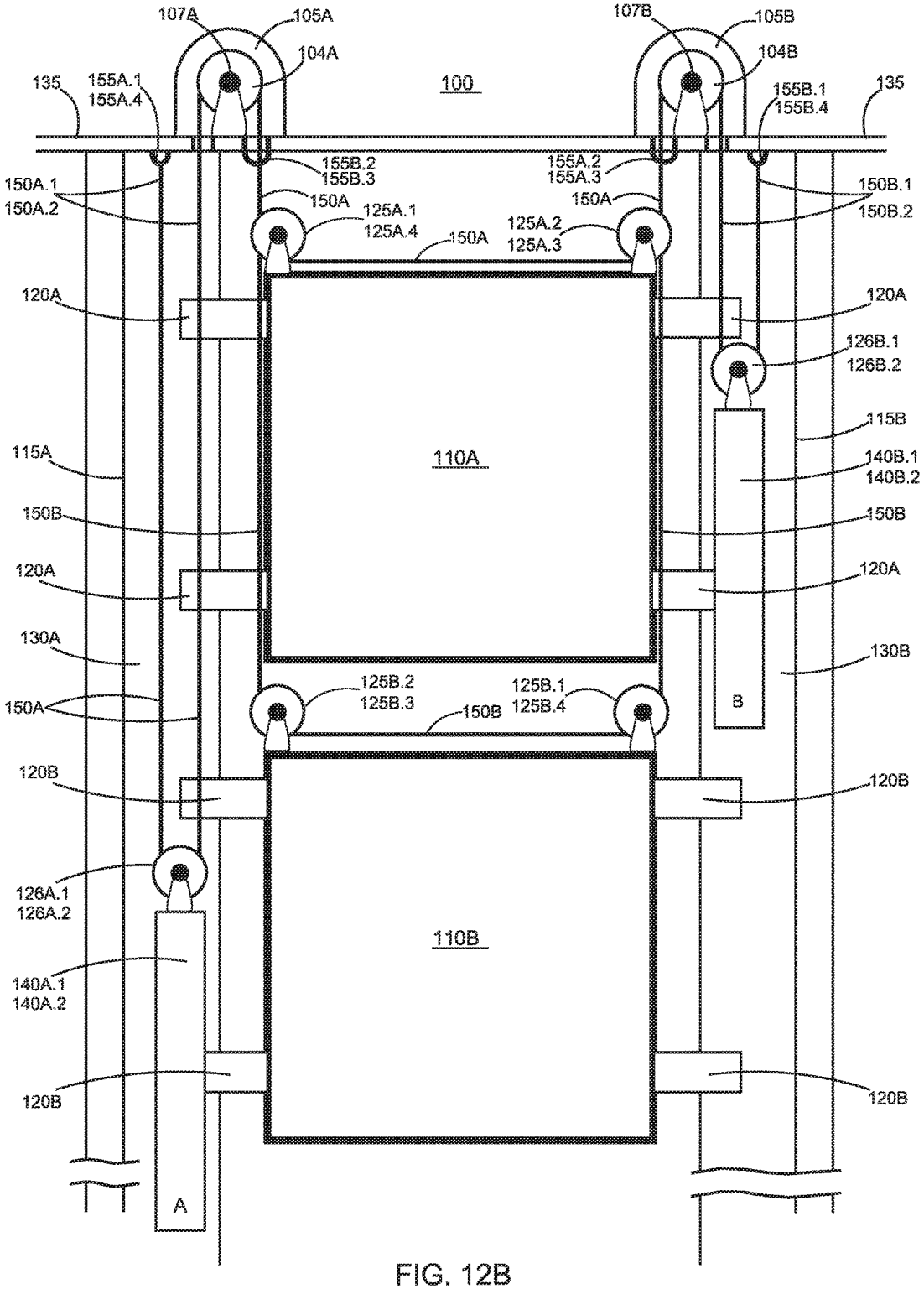
FIG. 12B is an illustration of a front view of an elevator shaft with two elevator cabs suspended by cables, one above the other, and their respective pulleys, guides, cables, counterweights, lift motors, axles, and traction sheaves, where the pulleys of the elevator cabs are mounted at a top of the elevator cab, according to an embodiment of the present invention.

In an embodiment of the invention, as illustrated in FIG. 12B, there is an elevator system comprising a plurality of elevator cabs operating independently of each other in an elevator shaft of a structure, the elevator system comprising: at least two elevator cabs 110A, 110B positioned vertically in the elevator shaft, each cab comprising suspension cables 150A, 150B that are slung over the top of the cab. In particular, each cab comprises a first set of suspension cables and a second set of suspension cables, equally spaced apart from a center of each cab and substantially parallel to a front wall and a rear wall of each cab, each set of cables connected to the cab by two sets of cab pulleys 125A, 125B located at a top of the cab such that each set of cables is slung over the top of the cab, wherein the two sets of cab pulleys for each set of suspension cables are symmetrically positioned at the top of the cab. Moreover, each cab comprises a lift motor at a top surface of the shaft comprising an axle and a traction sheave at each end of the axle, wherein a first traction sheave engages the first set of suspension cables and a second traction sheave engages the second set of suspension cables. In addition there is a counterweight for each set of suspension cables engaging a counterweight pulley, the first set of suspension cables connected at a first end to the top surface of the shaft, engaging a first counterweight pulley and a first counterweight, engaging the first traction sheave, engaging the two opposing cab pulleys at the top of the cab, and connected at a second end to the top surface of the shaft; the second set of suspension cables connected at a first end to the top surface of the shaft, engaging a second counterweight pulley and a second counterweight, engaging the second traction sheave, engaging the other two opposing cab pulleys at the top of the cab, and connected at a second end to the top surface of the shaft. According to an embodiment, each lift motor of each cab moves its corresponding two sets of suspension cables in unison with equal force and each of the elevator cabs is moveable rectilinearly within the elevator shaft independently of other cabs. Moreover, according to an embodiment, the two opposing cab pulleys for each set of suspension cables of each cab are progressively and symmetrically located closer to the center of each cab, such that for each cab, suspension cables, counterweights, pulleys, lift motors, axles, and traction sheaves will not horizontally or vertically conflict with each other.

Each counterweight 140 illustrated in this invention can be guided through each elevator shaft 100 by channels, rails, or tracks, which are not shown herein.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments or alternatives of the foregoing description.

The invention claimed is:

1. An elevator system comprising a plurality of elevator cabs operating independently of each other in an elevator shaft of a structure, the elevator system comprising:

at least two elevator cabs positioned vertically in the elevator shaft, each cab comprising:

a first set of suspension cables and a second set of suspension cables, equally spaced apart from a center of each cab and substantially parallel to a front wall and a rear wall of each cab, wherein for at least one elevator cab of the at least two cabs, each set of cables connected to each cab by two sets of cab pulleys located at a bottom of the cab such that each set of cables is slung under the bottom of the cab, wherein the two sets of cab pulleys for each set of suspension cables are symmetrically positioned at the bottom of the cab;

wherein for at least one other elevator cab of the at least two cabs, each set of cables connected to each cab by two sets of cab pulleys located at a top of the at least one other cab such that the at least one other elevator cab is suspended from suspension cables that engage cab pulleys above the at least one other elevator cab;

a lift motor at a top surface of the shaft comprising an axle and a first traction sheave at a first end of the axle and a second traction sheave at a second end of the axle, wherein the first traction sheave engages the first set of suspension cables and the second traction sheave engages the second set of suspension cables;

a counterweight for each set of suspension cables connected to a counterweight pulley, the first set of suspension cables connected at a first end to the top surface of the shaft, engaging a first counterweight pulley connected to a first counterweight, engaging the first traction sheave, engaging two opposing cab pulleys at the bottom of the at least one elevator cab or at the top of the at least one other elevator cab, and connected at a second end to the top surface of the shaft; the second set of suspension cables connected at a first end to the top surface of the shaft, engaging a second counterweight pulley connected to a second counterweight, engaging the second traction sheave, engaging another two opposing cab pulleys at the bottom of the at least one elevator cab or at the top of the at least one other elevator cab, and connected at a second end to the top surface of the shaft;

wherein each lift motor of each cab moves its corresponding two sets of suspension cables in unison with equal force and each cab is moveable rectilinearly within the elevator shaft independently of each cab; and wherein the two opposing cab pulleys for each set of suspension cables of each cab, from each cab to a next cab of the at least two cabs, are progressively and symmetrically located closer to the center of each cab with respect to the front wall and the rear wall, such that for each cab, suspension cables, counterweights, pulleys, lift motors, axles, and traction sheaves will not horizontally or vertically conflict with each other.

2. The elevator system of claim 1, comprising more than two elevator cabs operating in the elevator shaft.

3. The elevator system of claim 1, wherein the two opposing cab pulleys for each set of suspension cables for a first cab located above a second cab is located farther apart from the center of the first cab than two opposing cab pulleys for each set of suspension cables for the second cab.

4. The elevator system of claim 3, wherein the lift motor for the first cab is positioned on the top surface substantially over a first side wall of the cabs and the lift motor for the second cab is positioned on the top surface opposite the lift motor for the first cab, and substantially over an opposite second side wall of the cabs.

5. The elevator system of claim 1, wherein for each cab, the two opposing cab pulleys for each set of suspension cables are positioned at a first side wall of the cab and at an opposing second side wall of the cab respectively.

6. The elevator system of claim 1, further comprising:

a first vertical guide track positioned centrally on an a first shaft wall of the elevator shaft and an opposing second vertical guide track positioned centrally on a second shaft wall of the elevator shaft; and on each of the elevator cabs, a first guide centrally positioned on an exterior first side of a cab opposing the first vertical guide track and a second guide centrally positioned on an exterior second side of the cab opposing the second vertical guide track;

wherein the first guide and second guide on each cab engage with the first vertical guide track and second vertical guide track respectively.

7. The elevator system of claim 6, wherein each lift motor of each cab is positioned over the first vertical guide track or the second vertical guide track.

8. The elevator system of claim 6, wherein the axle of each lift motor of each cab is centered over the first vertical guide track or the second vertical guide track.

9. The elevator system of claim 6, further comprising on each cab, an additional guide centrally positioned on the exterior first side opposing the first vertical guide track and an additional guide centrally positioned on the exterior second side opposing the second vertical guide track.

10. The elevator system of claim 1, wherein for each lift motor, the first traction sheave and the second traction sheave are substantially equidistant from a center of the lift motor.

11. The elevator system of claim 1, wherein for each cab, the first counterweight and the second counterweight are equally weighted.

12. The elevator system of claim 1, wherein the first and second counterweights of a topmost first cab are positioned below the first and second counterweights of any cab below the topmost first cab.

13. The elevator system of claim 1, wherein for each cab, each first end and second end of each set of suspension cables is attached to the top surface by a separate cable hook.

14. The elevator system of claim 1, wherein for the at least one other elevator cab of the at least two cabs, the at least one other elevator cab is suspended from suspension cables that engage cab pulleys above the elevator cab in a way that suspension cables engage counterweight pulleys mounted on a top of counterweights.

15. The elevator system of claim 1, further comprising an additional elevator cab different from the at least two elevator cabs and located above all other elevator cabs in the elevator shaft, the additional elevator cab suspended by cables connected to a center of a top of the additional elevator cab.

16. The elevator system of claim 1, wherein the suspension cables that suspend each elevator cab in the elevator shaft, move up and down the elevator shaft with each elevator cab, and thus said suspension cables do not obstruct a vertical motion of any of the cabs.

* * * * *